US006425212B1

(12) United States Patent
Lovazzano

(10) Patent No.: US 6,425,212 B1
(45) Date of Patent: Jul. 30, 2002

(54) STRESS-TENSION HAZARD CONCRETE SLAB INDICATING DEVICE AND SYSTEM

(76) Inventor: Gary Lovazzano, 1005 Stern La., Foster City, CA (US) 94404

( * ) Notice: Subject to any disclaimer, the term of this patent is extended or adjusted under 35 U.S.C. 154(b) by 0 days.

(21) Appl. No.: 09/310,658

(22) Filed: May 12, 1999

(51) Int. Cl.[7] ..... E04C 5/08

(52) U.S. Cl. ..... 52/105; 52/223.1; 52/511; 52/512

(58) Field of Search ..... 52/103, 105, 223.1, 52/511, 512

(56) References Cited

U.S. PATENT DOCUMENTS 1,531,754 A * 3/1925 Palmer ..... 52/103 X
1,624,048 A * 4/1927 Haggenjos ..... 52/103 X
3,964,219 A * 6/1976 Hala ..... 52/105
4,027,711 A * 6/1977 Tummarello ..... 52/105 X

* cited by examiner

*Primary Examiner*—Christopher T. Kent
(74) *Attorney, Agent, or Firm*—Peninsula IP Group; Douglas A. Chaikin

(57) ABSTRACT

A prestressed or post-tensioned concrete slab indicating device for indicating a presence of a prestressed or post-tensioned slab of concrete includes a plate member having a front surface and a back surface, a visible indication on the front surface, the visible indication communicating and warning of the presence of a prestressed or post-tensioned slab of concrete, at least one concrete penetrating projection having a proximal and a distal end, the proximal end being attached to the back surface, the projection having a flared portion at the distal end, the at least one concrete penetrating projection being at least partially embedded within a partially cured prestressed or post-tensioned concrete slab to affix the indicating device to the partially cured prestressed or post-tensioned concrete slabsuch that the front surface of the indicating device is flush with the concrete surface, the flared portion keeping the device securely attached to the slab when the prestressed or post-tensioned concrete slab is fully cured.

14 Claims, 5 Drawing Sheets

STRESS-TENSION HAZARD CONCRETE SLAB INDICATING DEVICE AND SYSTEM

BACKGROUND OF THE INVENTION

1. Field of the Invention

The present invention relates to the field of safety warning devices and systems for construction, commercial and residential sites. More particularly, the present invention relates to warning devices and systems for warning construction workers, commercial building owners and home improvers of the dangers inherent in certain types of concrete slabs.

2. Description of the Related Art

Concrete, as used in the construction industry, is a mixture of one or more inert aggregate materials, a binding material such as portland cement, and water. The mixture is cast into a formwork, generally a wooden mold which holds the concrete during the pouring and curing stages. The slurry mixture then cures, hardening by a chemical reaction. In this manner, a cast concrete member of uniform thickness is produced. This cast member is generally referred to as a concrete slab.

Concrete alone is inherently incapable of resisting tension. For that reason, steel reinforcing is used to strengthen concrete. Reinforcing steel bars are known in the industry as rebars. These rebars reinforce the concrete by imparting the tensile characteristics of the reinforcing steel to the concrete. Thus, the bond between the concrete and the rebars must be sufficient to keep them from being pushed or pulled out of the slabs.

In unstable areas, and in situations where high loading tensions are expected, a stiffer beam is desired. For that reason, design and safety considerations often dictate the use of prestressed or post-tensioned concrete slabs. In such slabs, the presence of pre-applied compressive stresses in the tension region of a beam prior to normal loading will cause the beam to undergo less deflection once the intended load is applied. In other words, prestressing or post-tensioning concrete slabs produces stiffer beams. These stiffer beams greatly increase stability and safety of the structures erected therewith. Alternatively, smaller beams can be employed in place of larger and weaker ones, thus reducing both the cost and weight of the structures constructed.

In both prestressed and post-tensioned concrete slabs, steel tendons are laid down within the beam prior to pouring and curing of the concrete slab. In prestressed concrete slabs, tension is applied to the steel tendons prior to pouring and curing the slab. This is done by attaching the steel tendons to anchors and applying tension thereto. The concrete mixture is then poured within the formwork, and the concrete slab allowed to cure. The steel tendons are then severed, thereby transferring the tension to the concrete. In post-tensioned concrete slabs, the formwork is built with tubes running from end to end. The steel tendons are then inserted within the tubes, and the concrete poured. After the concrete cures, a desired tension is applied to the steel bars within their respective tubes. The tubes are then filled with, for example grout, or the terminal portions of the tendons are anchored to the slab in some manner. Alternatively, greased tendons may be used, the grease coating preventing the steel tendons from bonding to the concrete as it cures.

The tensions applied to the steel tendons, in either the prestressed or post-tensioned situations are great, on the order of tens of thousands of pounds of force. Tensioning forces on the order of 20,000 lbs. are typical. While this tensioning produces a stiff slab of concrete well suited to high stress building situations, use of pre or post-tensioned concrete slabs is not without dangers.

In particular, if the bond between the concrete and the steel tendons is reduced somehow, there exists the real danger that the forces applied to them will catastrophically release in an unintended manner. Alternatively, if the structural integrity of the steel tendons is compromised in any manner, the forces applied to the steel tendons can cause them to shoot out of the concrete slabs with great force. This can happen, for example, if the prestressed or post-tensioned concrete slab is drilled, or in any way penetrated, and the drill bit or penetrating element encounters one of the highly tensioned steel tendons. This can also happen if nails or bolts are driven into a pre or post-tensioned slab of concrete. The steel tendons can then whip unexpectedly out of the concrete slab with a force nearly equal to that applied to them when the slab was formed. The violent release of these tensioned steel tendons has been known to injure and kill people and damage property.

Thus, construction workers, homeowners, or commercial building owners who are unaware that tensioned concrete slabs have been used in their site, building or home are in grave danger of a potentially fatal injury should they, for any reason, drill, nail, drive a bolt into or through, or in any way penetrate the prestressed or post-tensioned concrete slabs. Even penetrating one inch in such slabs is highly dangerous, as the tensioning steel tendons often come to within an inch of the surface of the slab.

What is desired is a means for warning construction workers, commercial building owners, homeowners and all others of the presence of prestressed or post-tensioned concrete slabs within their job site, building or homes.

Conventional devices and methods are known which indicate the location of various electrical, communications and structural members embedded within cement or concrete slabs. One such device is disclosed in U.S. Pat. No. 2,854,840 to Anderson.

Anderson discloses a wire comprising a number of magnetic markers attached thereon. The wire and magnetic markers are embedded within cement floors and indicate the presence of power or communications lines therein. However, a compass is needed to detect these magnetic markers, rendering them invisible to the unaided eye. They are, as such, poorly suited as indicating or warning devices to warn, for example, construction workers at a job site of the presence of potentially dangerous prestressed or post-tensioned concrete slabs.

Another approach was taken by Bates, as disclosed in U.S. Pat. No. 5,003,735. In Bates, resilient fibers project from the surface of a poured concrete surface to indicate the presence of, for example, power lines, to help in locating potential electrical outlets. The resilient nature of the projecting fibers allows them to resiliently yield upon engagement by means employed in finishing the outer surface of the concrete or cement slab. It is apparent that these fibers, although resilient, will interfere with the various polishing processes used in finishing concrete or cement slabs. Indeed, these resilient fibers could get caught in the polishing machine, thus causing delays and further costs.

Palmer, in U.S. Pat. No. 1,531,754, discloses a device wherein an inscription plate is fastened to a concrete slab by inserting a bolt through a plate-and-anchor combination previously imbedded in the cement.

In the approach taken by Haggenjos in U.S. Pat. No. 1,624,048, an anchor is cast into the concrete and an inscription plate is applied afterward.

The devices set forth by Palmer and Haggenjos are not flush with the concrete surface and would not be suitable for prestressed or post-tensioned concrete slabs, as the outward projection of a bolt, plate, or other parts could interfere with the polishing of the concrete. Additionally, inserting a fastener into an anchor of unspecified length, such as described by Palmer, could cause the anchor to press outward and into the slab, creating just the kind of hazard which it is desired to avoid.

Kramer et al., in U.S. Pat. No. 4,979,462, disclose a device and a method for indicating the location and direction of various structural members in concrete members. In said patent of Kramer et al., an indicator device is disclosed which spans the width of the concrete slab, the indicator device having both top and bottom indicators. The disclosed indicator assembly consists of a post having a length substantially equal to the width of the concrete slab, the post supporting, at its extremities, the top and bottom indicators. Each of the top and bottom indicators are secured onto the posts by a retaining collar. Furthermore, the indicator assembly relies on a clamping assembly which is connected, via a sleeve arrangement, to the post such that the clamping assembly slides along the post. The clamping assembly, in turn, comprises coupling means having a slot in which the structural member, or strengthening cable, is to be inserted. The Kramer et al. device has many parts and is complicated, and the device of Kramer et al. requires different lengths of posts, one length for each different thickness of concrete slab utilized at the job site. Moreover, a great many number of tensioned steel tendons are used within many prestressed or post-tensioned concrete slabs. Often these steel tendons are laid crisscrossing-crossing each other, forming a checkerboard of steel tendons within the concrete slab. Therefore, to effectively warn people of the presence of all such steel tendons, a great many such devices are required, rendering the practical use of the Kramer et al. device unrealistic and impractical. In addition, each of the Kramer et al. devices must be installed and adjusted manually before the concrete is cast. By virtue of this, the device disclosed in the Kramer et al. patent is inherently expensive, and necessitates a large amount of time to set up properly. In addition, the Kramer et al. device is inherently non-removable, as it cannot be removed from the concrete slab once the slab has been cast. Thus the costs associated with utilizing such devices greatly increase, and the number of such devices necessary to indicate each individual reinforcing member unreasonably increases the time required to complete the casting of the concrete slabs. The extra time and cost necessary for use of the Kramer et al. device constitutes a disincentive to its use. Contractors bidding on projects will be unlikely to specify its use and insurance companies will also be unlikely to consider these indicator devices a statistically cost effective means for preventing injury and damage to property.

What is desired, therefore, is a warning device or system that is simple, has few or no moving parts, is easy to install, has the potential to be installed by machine rather than manually, is cost-effective for the purchaser, and is highly visible. What is also desired is a warning device which does not compromise the integrity of the prestressed or post-tensioned concrete slab in which it is installed. What is further desired is a removable warning device or system that can be installed during construction and removed after construction if the device is placed in a location where the prestressed or post-tensioned slabs are unlikely to be disturbed. What is additionally desired is a warning device or system which will not interfere with the polishing or other further processing and use of the concrete slab in which the warning device is installed. What is desired, furthermore, is a warning device or system that is inexpensive to manufacture, is easily installed, is removable, and which will effectively communicate the presence of prestressed or post-tensioned concrete slabs.

SUMMARY AND OBJECTS OF THE INVENTION

It is an object of the present invention to provide a simple warning device and system for warning construction workers, commercial building owners and homeowners of the presence of prestressed or post-tensioned concrete slabs within their job site, building, home or any other structure.

It is another object of the present invention to provide a warning device and system that is simple, has few parts, is inexpensive to manufacture and is quick to install.

It is a further object of the present invention to provide a warning device and system that is securely attachable, durable, highly visible and removable.

In accordance with the above objects and those that will be mentioned and will become apparent below, a stress-tension hazard indicating device for indicating the presence of prestressed and post-tensioned concrete members comprises:

a plate member with a front surface and a back surface, and which is designed to be installed in a partially cured concrete slab such that the front surface of the plate member will be flush with the concrete surface when the concrete surface is fully cured;

a visible indication on the front surface of the plate member, the visible indication signifying the presence of a hazard;

at least one through hole in the plate member and/or at least one projection in the rear surface of the plate member, which is used to removably attach the plate member to at least one concrete penetrating projection;

at least one device for removably connecting the plate member to at least one concrete penetrating projection, either via a through hole in the plate member or via a projection in the rear surface of the plate member, such that the connecting device is flush with or under the plate member after the assembly is installed in concrete;

at least one concrete penetrating projection having a proximal and a distal end, a portion at the distal end which is flared or otherwise configured such that the concrete penetrating projection will be securely anchored in a cured concrete slab after prior installation in the partially cured slab, and the proximal end being attached to the back surface of the plate member with at least one connecting device which is flush with the surface of the plate member or below the plate member;

whereby, a concrete member is provided with a flush tendon hazard warning indicator from a time no later than the time at which the concrete member is fully cured.

In another embodiment of the present invention, the stress-tension hazard indicating system, comprises a plate member having a front surface, the plate member having at least one through hole, a visible indication on the front surface, the visible indication communicating a presence of a prestressed or post-tensioned slab of concrete, at least one anchor member; and at least one fastener, the fastener being removably insertable through respective ones of the at least one through hole into respective ones of the at least one concrete anchor, whereby, when the at least one concrete anchor is embedded within a partially cured prestressed or post-tensioned concrete slab and remains therein as the slab cures, the plate member is removably attachable to the prestressed or post-tensioned concrete slab by inserting the at least one removable fastener through the at least one through hole into the at least one concrete anchor.

The foregoing and other objects, features and advantages of the present invention will become more readily apparent from the following detailed description of the preferred embodiments, which proceeds with reference to the drawing.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 8:
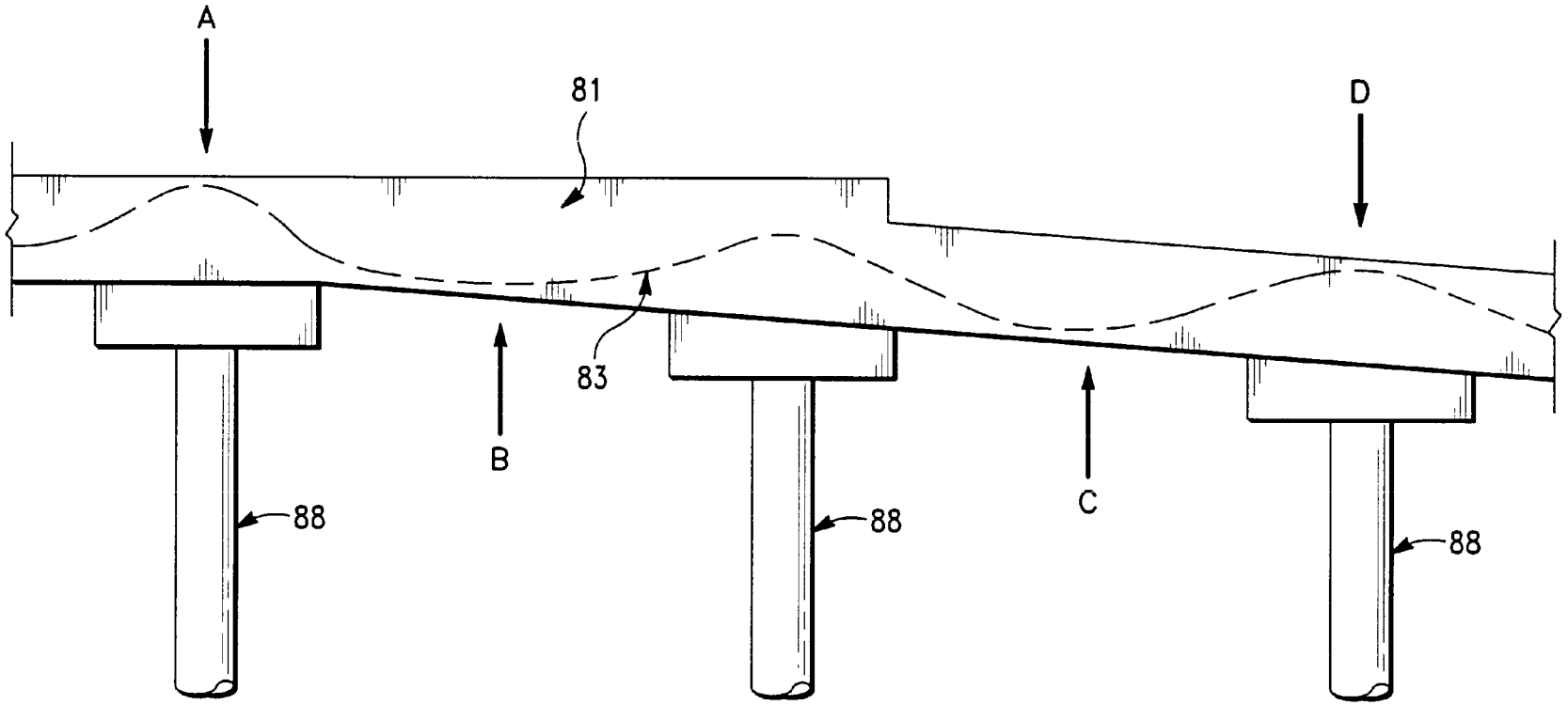
FIG. 8 shows a cross-section of a post-tensioned concrete slab of concrete.

FIG. 8 shows a post-tensioned concrete slab 81. The post-tensioned concrete slab 81 is supported by a plurality of supporting columns 88. Within the post-tensioned concrete slab 81 are disposed a plurality of tensioned tendons 83. The tensioned tendons 83 may follow a curved path and may come within one inch of the outer surface of the slab 81, at the points indicated by arrows A, B, C, and D. Penetrating, in any way, the tensioned concrete slab 81, therefore, is highly dangerous, particularly at and around the points labeled A, B, C, and D.

Figure 1:
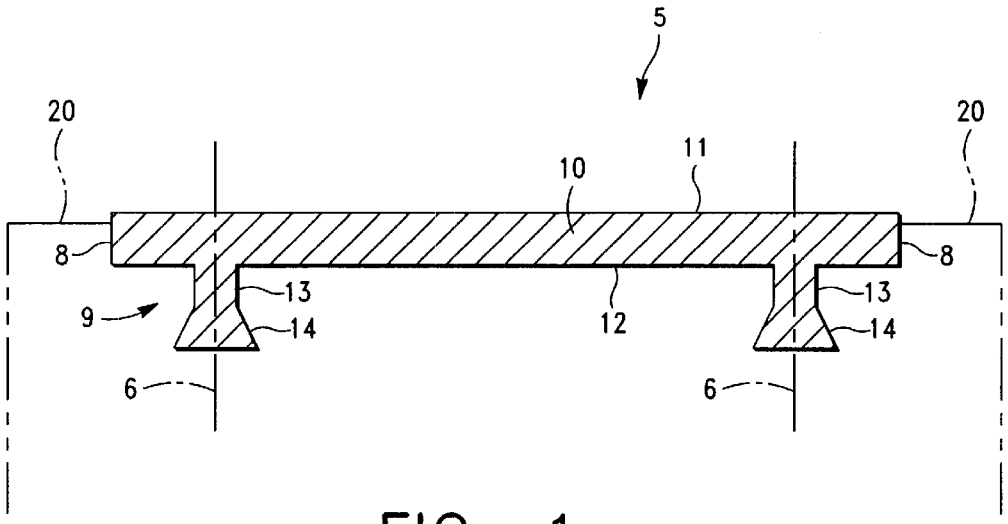
FIG. 1 is a side view of one embodiment of the indicating device according to the present invention, embedded in a prestressed or post-tensioned concrete slab.

FIG. 1 shows a stress-tension hazard indicating device 5 according to an embodiment of the present invention. The indicating device 5 includes a plate member 10 having a front surface 11, a back surface 12, and side surfaces 8. The top surface 11 includes a visible indication to communicate the presence of a prestressed or post-tensioned concrete slab. The visible indication may be a graphic symbol or alternatively, may be a lettered warning such as:

| WARNING<br>POST-TENSIONED CONCRETE SLAB<br>DO NOT PENETRATE |
|---|

The indicating device includes concrete penetrating projections 9. The concrete penetrating projection 9 includes an elongated portion 13 and a flared portion 14. The longitudinal axes 6 of the projections are substantially perpendicular to the surfaces 11 and 12. The projections 9 may be unitary and integral with the plate member 10, or may be separately formed and attached to one another in a conventional manner. When the indicating device 5 according to the present invention is used, the plate member 10 is embedded within a partially cured prestressed or post-tensioned concrete slab 20, so that the front surface 11 is substantially flush with the surface of the concrete slab 20. The concrete being only partially cured, it flows around the projections 9 and around and under the flared portions 14. As the concrete cures, it bonds to the projections 9, to the back surface 12 and to the side surfaces 8 of the plate member 10, thus securely attaching the plate member 10 thereto. The flared portions keep the indicating device 5 from being inadvertently pulled out from the concrete slab, and securely anchor the device 5 to the concrete slab 20. In this manner, a permanent indicating device 5 is securely attached to the concrete slab 20, warning all who see it that the slab 20 to which the indicating device 5 is affixed is a prestressed or post-tensioned concrete slab.

Figure 2:
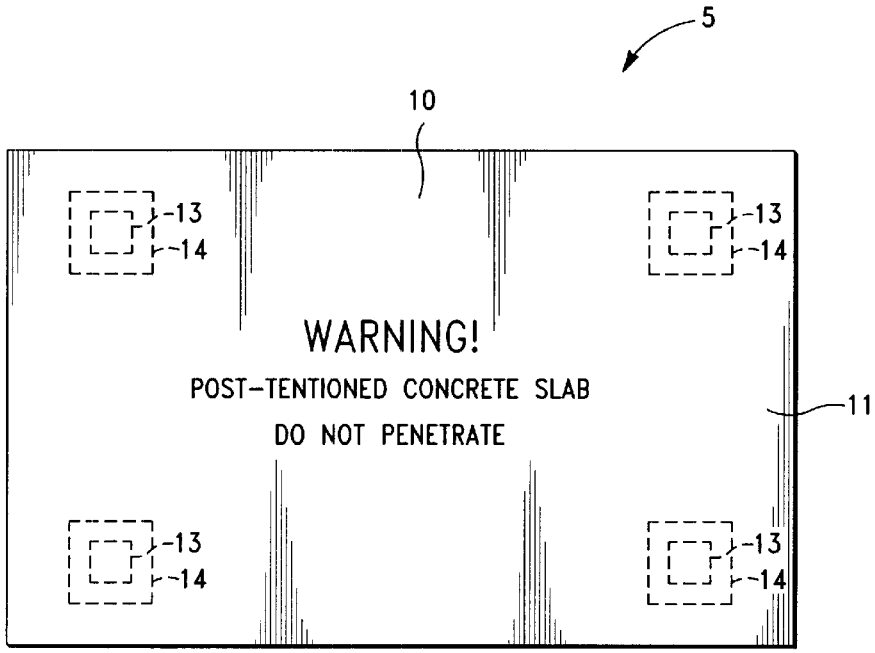
FIG. 2 is a plan view of the indicating system of FIG. 1.

FIG. 2 shows a plan view of the front surface of the stress-tension hazard indicating device according to the present invention. As the projections 9 attached to the back surface 12 are not normally visible in such a view, they are shown in dashed lines. A lettered warning, for example, appears clearly on the top surface of the plate member 10, to warn of the presence of a prestressed or post-tensioned concrete slab. This warning may alternatively be a graphic symbol, or a combination of a graphic symbol and a lettered warning. The device 10 has, for example a rectangular shape, and has a projection 9 near each corner of the rectangle shape.

Figure 3A:
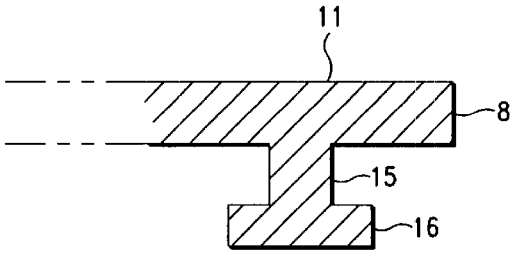
FIG. 3A is a fragmentary side view of another embodiment of the present invention.
Figure 9:
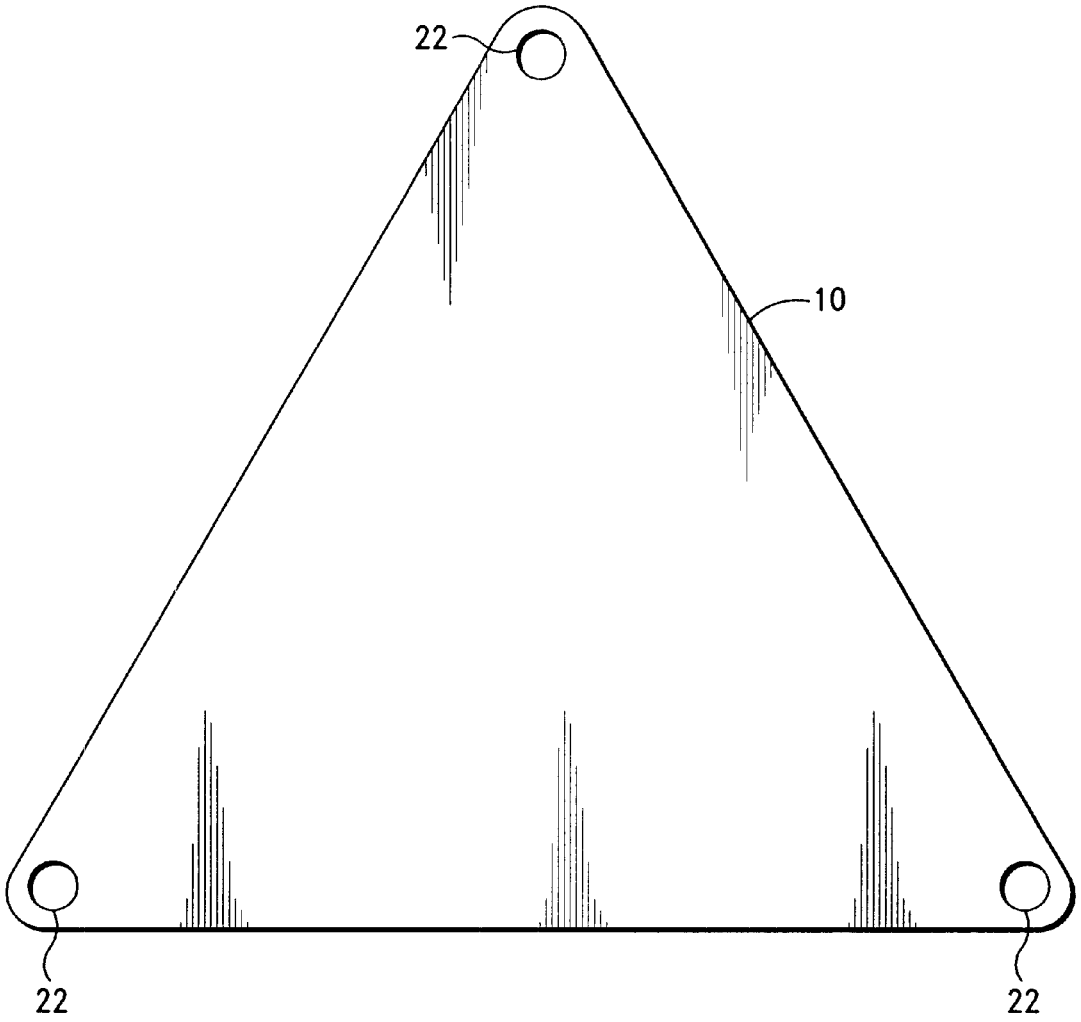
FIG. 9 is a plan view of an alternative embodiment of the indicating device.

As can be seen in FIG. 2, the elongated portions 13 and the flared portions 14 have a rectangular footprint. Those of ordinary skill will readily recognize that other shapes are possible, for both the plate member 10 itself, as well as for the projections 9, comprising the elongated portions 13 and the flared portions 14. For example, the plate member 10 may be triangular in shape (FIG. 9), round, elliptical, or most any other shape without departing thereby from the spirit of the present invention. Likewise, the elongated portions 13 and the flared portions 14 may also assume most any shape, such as cylindrical, as shown in FIG. 3A, which shows a side view of an elongated portion which is cylindrical in shape, as well as a cylindrical flared portion 16.

Figure 3B:
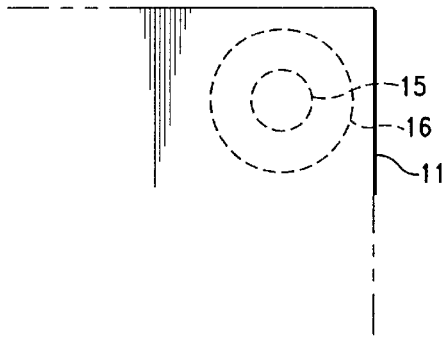
FIG. 3B is a plan view of the embodiment shown in FIG. 3A

FIG. 3B shows a plan view of a portion of the indicating device of FIGS. 1 and 2, equipped with a cylindrical elongated portion 15 and a cylindrical flared portion 16. The indicating device shown in FIGS. 1 through 3B are non-removable. This means that this indicating device is embedded in partially cured concrete and allowed to remain embedded therein as the concrete cures. As such, the indicating device 5 shown in these figures constitutes a substantially permanent installation well suited for prestressed and post-tensioned concrete slab applications that are to remain within public view, or are susceptible to being drilled or penetrated into at some future date. In such situations, a permanent installation is desirable, one that will become a permanent part of the building or structure and will warn people of the inherent dangers of drilling, driving bolts into or otherwise penetrating the slab for the life of the structure. Mounting one such indicating device every 10 feet or so onto prestressed or post-tensioned concrete slabs should provide adequate indication and warning of the dangers inherent in such prestressed or post-tensioned concrete slabs. Of course, the number of such indicating devices and their mutual spacing can and should be freely adapted to the particular site in question.

There are other situations, however, wherein it is not desirable or necessary to permanently mount such warning or indicating devices within the concrete slabs. Such situations might be ones where the slab is to be rendered inaccessible to people who might wish to drill, drive bolts, or otherwise penetrate therein. Alternatively, economic considerations might dictate that such warning devices be removable. These considerations might also dictate that these removable devices also be reusable.

An embodiment of the present invention that satisfies these constraints is shown in FIGS. 4 through 7.

Figure 4:
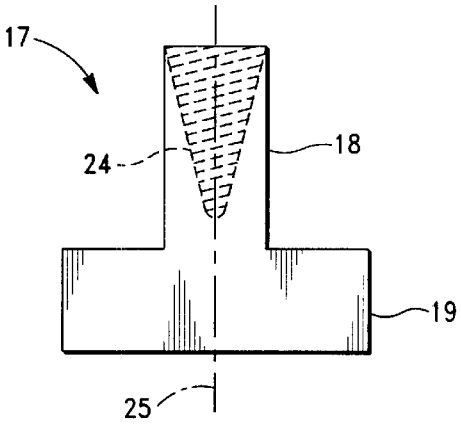
FIG. 4 is a side view of the anchor used in the indicating system according to the present invention.
Figure 5:
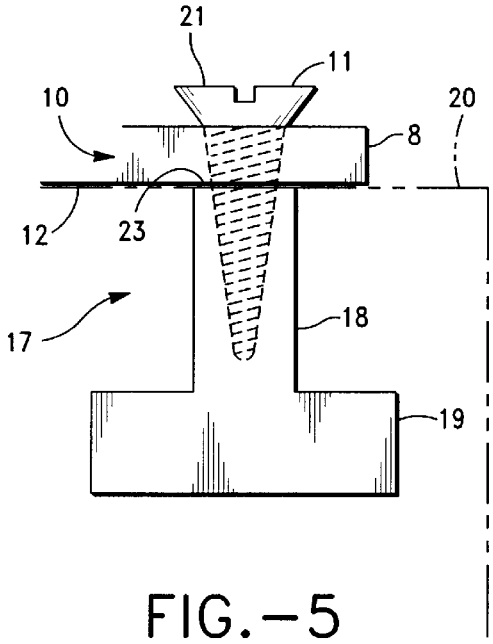
FIG. 5 is a fragmentary side view of the indicating system according to the present invention embedded in a prestressed or post-tensioned concrete slab.
Figure 6:
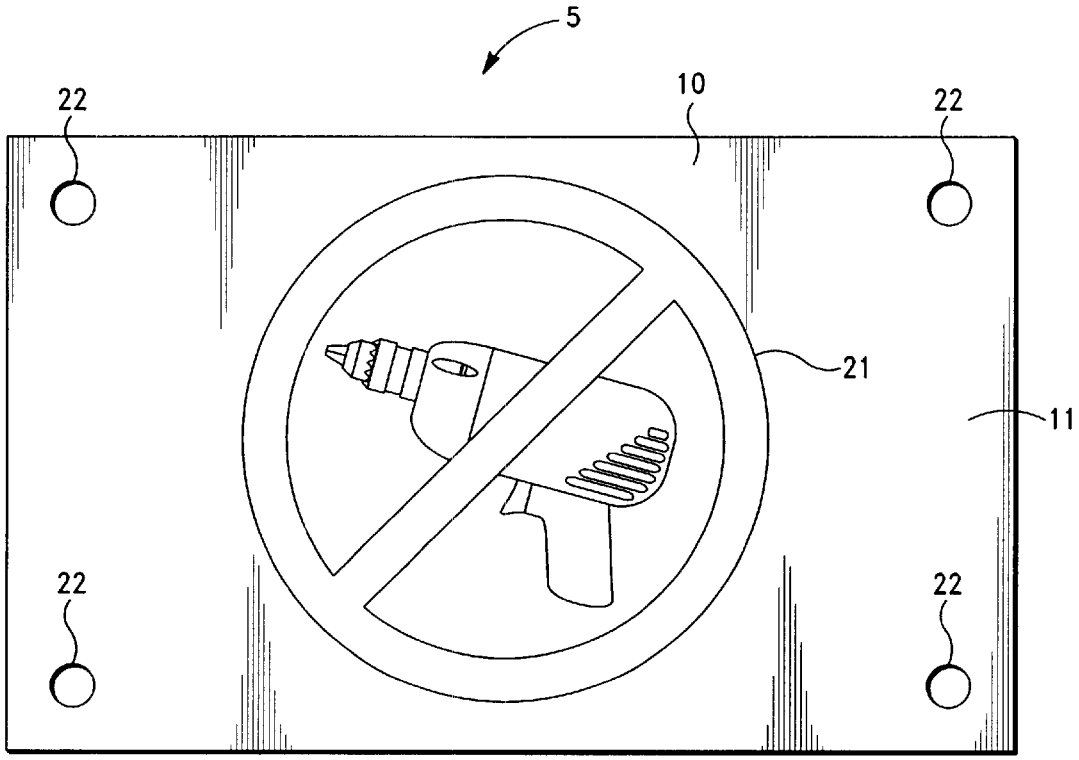
FIG. 6 is a plan view of a plate member of the indicating system according to the present invention.
Figure 7:
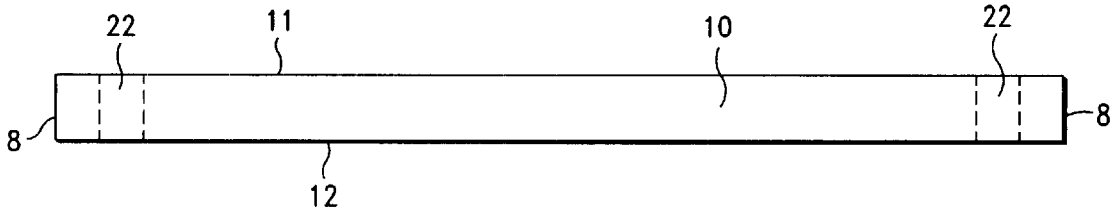
FIG. 7 shows a side view of the plate member shown in FIG. 6.

FIGS. 4 through 7 show, in combination, an embodiment of a stress-tension hazard indicating system for indicating the presence of a post-tensioned or prestressed slab of concrete. The system according to the present invention comprises a plate member 10, as shown in FIG. 6. In FIG. 6, instead of the lettered visible indication, as shown in FIG. 2, a stylized graphic symbol 21 is used as the visible indication of the presence of a prestressed or post-tensioned concrete slab. This visible indication is stamped, impressed, silk screened, printed or otherwise affixed on the top surface 11 of the plate member 10. Such stylized symbols are universally and intuitively understandable, even to those lacking the ability to read. Indeed, those looking at this device will know not to penetrate the concrete slab, even though they may not know the reasons behind the prohibition. The plate member 10 includes through holes 22 which are located near the corners of the plate member 10. Of course, the plate member 10 may be round, triangular, or most any other shape, without departing from the present invention. FIG. 7 shows a side view of the plate member 10 shown in FIG. 6. The plate member 10 includes a top surface 11, a back surface 12 and side surfaces 8. Through holes 22 can be seen in dashed lines.

In use, the plate member 10 is used in combination with anchors to be embedded within the concrete slab, and removable fasteners. One such anchor is shown in FIG. 4. The anchor 17, in FIG. 4, includes a first portion 18 having an elongated shape, and a second portion 19, having a flared shape. The flared second portion 19 may be substantially perpendicular to the longitudinal axis 25 of the elongated portion 18, and prevents the anchor 17 from being readily pulled out of the concrete slab once it is embedded therein and the concrete has cured. The elongated first portion 18 may be threaded with threads 24, so as to cooperate with a removable fastener, such as a bolt or a screw.

Alternatively, the plate member 10 can be used without the anchors 17, by hanging the plate member on an appropriate surface by means of string or wires (not shown) threaded through the holes 22.

FIG. 5 shows a side view of a portion of the flush mounted indicating system according to the present invention. The anchor 17, in FIG. 5, is embedded within the concrete slab, referenced by numeral 20. This anchor 17 is embedded within a partially cured concrete slab 20, so that the top most portion 23 of the elongated first portion 18 is substantially flush with the surface of the concrete slab 20. The concrete slab 20 is then allowed to cure, so as to securely attach the anchor therein. The back surface 12 of the plate member 10 is then placed on the concrete slab 20, and the through holes 22 are lined up with corresponding anchors 17 at each corner of the plate member 10. Removable fasteners 21 are then inserted though the through holes and into the anchors 17. The removable fasteners may be threaded in a complimentary manner relative to the anchor threads 24. The removable fasteners may be, for example, screws or bolts. When it is desired to remove the plate members 10 for later eventual reuse, the plate members 10 may easily be removed from the concrete slab 20 by removing the removable fasteners 21. The anchors 17 then remain embedded within the concrete slab 20, but do not interfere in any way with the structural integrity of the slab, nor do they protrude therefrom, to catch or snag objects or people. The plate member 10 can then be reused at will, leaving only a small and inexpensive anchor 17 embedded within the concrete slab 20. The fasteners 21 may then be re-inserted in the anchors 17, so as to close and cover them.

Mounting one such indicating device every 10 feet or so onto prestressed or post-tensioned concrete slabs such as shown in FIG. 8 should provide adequate indication and warning of the dangers inherent in such prestressed or post-tensioned concrete slabs. The number of such indicating devices and their mutual spacing should be adapted to the particular site in question.

While the foregoing detailed description has described several embodiments of the stress-tension hazard indicating device and system according to the present invention, it is to be understood that the above description is illustrative only and not limiting of the disclosed invention. Upon reading the above description, it will become apparent to those of ordinary skill that many modifications and variations are possible without departing from the spirit of the present invention. For example, the shape of the plate member 10 may be changed and freely adapted to the needs of the situation at hand. The concrete anchors 17 may have a shape different from that disclosed. Accordingly, it is intended that the scope of the invention be defined only by the following claims.

What is claimed is:

1. A stress-tension hazard indicating device for indicating the presence of at least one prestressed and post-tensioned member within a mass of concrete comprising:

a plate member having a front surface, a back surface, and a visible indication on the front surface, the visible indication signifying the presence of a tensioning member:

at least one concrete penetrating projection, having a proximal end and a distal end, the proximal end being removably attached to the back surface of the plate member and the distal end having a flared portion, the concrete penetrating projection to be partially embedded within a concrete member from a time before the concrete member is fully cured, to a depth such that the removably attached plate member is flush with the surface of the concrete member;

whereby, a concrete member is provided with a stress-tension hazard warning indicator from a time no later than the time at which the concrete member is fully cured.

2. A stress tension hazard indicating device as set forth in claim 1, wherein a longitudinal axis of the concrete penetrating projection is substantially perpendicular to the front surface.

3. A stress-tension hazard indicating concrete member as set forth in claim 1, wherein the concrete penetrating projection is unitary and integral with the plate member.

4. A stress-tension hazard indicating device as set forth in claim 1, wherein the visible indication comprises at least one of a lettered indication or a graphic to warn of the presence of a hazard.

5. A stress-tension hazard indicating system for indicating at least one prestressed and post-tensioned concrete member, comprising:

a plate member having at least one through hole, a front surface which bears a visible indication signifying the presence of a tensioning member, and a rear surface;

at least one anchor member, the anchor member being embedded within said concrete member from a time before the concrete member is fully cured; and such that the plate member is flush with the surface of the fully cured concrete member, at least one removable fastener, said fastener being removably insertable through a through hole into anchor member, thereby securing the plate member to the anchor member such that no part of the fastener protrudes beyond being flush with the concrete surface;

whereby a concrete member is provided with a removably attachable stress-tension hazard warning indicating system from a time no later than the time at which the concrete member is fully cured.

6. A stress-tension hazard indicating system as set forth in claim 5, wherein the anchor member is embedded within said partially cured prestressed or post-tensioned concrete member to a depth of about 1 inch.

7. A stress-tension hazard indicating system as set forth in claim 5, wherein the anchor member is threaded, and wherein the removable fastener is one of a bolt and a screw.

8. A stress-tension hazard indicating system as set forth in claim 5, wherein the anchor member comprises a first portion and a second portion, the first portion having an elongated shape for receiving the fastener and the second portion projecting from the first portion to securely retain the anchor member within the prestressed or post-tensioned concrete when the concrete member has cured.

9. A stress-tension hazard indicating system as set forth in claim 8, wherein the second portion projects substantially perpendicularly relative to a longitudinal axis of the first portion.

10. A stress-tension hazard indicating system as set forth in claim 8, wherein the first and second portions of the at least one anchor member are unitary and integral relative to one another.

11. A stress-tension hazard indicating system as set forth in claim 5, wherein the visible indication comprises at least one of a lettered indication and a graphic to warn of the presence of a stress-tension hazard in the concrete.

12. A stress-tension hazard indicating system as set forth in claim 5, wherein the plate member has a triangle shape and comprises a through hole near each apex of the triangle shape.

13. A stress-tension hazard indicating system as set forth in claim 5, wherein the plate member is shaped as a rectangle and comprises a through hole at each corner.

14. A tendon hazard indicating system for attachment to concrete members to warn of the presence of prestressed and post-tensioned tendons therein, comprising:

a plate member having at least one through hole and a front surface bearing a visible indication signifying a hazard;

at least one anchor member, the anchor member including a first portion having an elongated shape for receiving a fastener; and a second portion, projecting from the first portion and formed unitary and integral therewith, including a broadened distal end suitable for securely retaining the anchor member within concrete; and at least one fastener, having an unattached position relative to the anchor member, and further being insertable through a through hole of the plate member to an attached position relative to the anchor member, and having additionally a sealing position relative to the anchor member wherein in the absence of the plate member the fastener closes the anchor member, whereby, a tendon hazard indicating plate is attachable to a concrete member from a time at least as early as the partial curing thereof and is removable therefrom, whereupon the fastener in the absence of the plate is insertable in the anchor to close the anchor member without protruding therefrom.

* * * * *